US007793781B2

(12) United States Patent
Hoyt

(10) Patent No.: US 7,793,781 B2
(45) Date of Patent: Sep. 14, 2010

(54) COMBINATION ARTICLE STORAGE CONTAINER AND NOVELTY ITEM

(76) Inventor: Jeffrey C. Hoyt, 599 Rte. 390, Rowena, New Brunswick (CA) E7H 4N2

( * ) Notice: Subject to any disclaimer, the term of this patent is extended or adjusted under 35 U.S.C. 154(b) by 54 days.

(21) Appl. No.: 12/011,613

(22) Filed: Jan. 28, 2008

(65) Prior Publication Data

US 2008/0197031 A1 Aug. 21, 2008

Related U.S. Application Data

(60) Provisional application No. 60/900,159, filed on Feb. 8, 2007.

(51) Int. Cl.
*B65D 69/00* (2006.01)

(52) U.S. Cl. ..... 206/223; 206/769; 206/457; 446/73; 446/75; 312/138.1; 472/57

(58) Field of Classification Search ..... 206/223, 206/457, 803, 775, 776, 769, 570, 572; 169/51; 312/138.1; 446/73, 75, 71, 72, 76, 77, 227; 472/73.75

See application file for complete search history.

(56) References Cited

U.S. PATENT DOCUMENTS 3,067,822 A * 12/1962 Hattenhauer ..... 169/51
4,449,588 A * 5/1984 Benlolo et al. ..... 169/48
4,903,513 A 2/1990 Stobbart
4,998,587 A * 3/1991 Thomas ..... 169/51
5,638,906 A * 6/1997 McCabe ..... 169/51
5,868,477 A * 2/1999 Decarie ..... 312/245
5,908,112 A * 6/1999 Hardie ..... 206/525

* cited by examiner

*Primary Examiner*—Mickey Yu
*Assistant Examiner*—Chun Cheung
(74) *Attorney, Agent, or Firm*—James Ray & Assoc

(57) ABSTRACT

A combination article storage container and novelty item includes a housing having a first predetermined size and first predetermined shape and being manufactured from a first predetermined material. A predetermined article is contained within such housing. A mechanism releasably attaches such predetermined article within such housing at a predetermined location therein. An outwardly facing transparent front panel manufactured from a second predetermined material is attached to such housing at a predetermined location thereon. A mechanism provides access to remove and replace such predetermined article. A tool member is operably connected to such housing at a predetermined location on an outside of such housing for giving the appearance that in order to obtain such predetermined article such tool must be used to break the transparent front panel.

14 Claims, 2 Drawing Sheets

COMBINATION ARTICLE STORAGE CONTAINER AND NOVELTY ITEM

CROSS REFERENCE TO RELATED APPLICATION

This patent application is related to and claims priority from U.S. Provisional Patent Application Ser. No. 60/900,159 filed Feb. 8, 2007.

FIELD OF THE INVENTION

The present invention relates, in general, to storage containers and, more particularly, this invention relates to novelty items.

BACKGROUND OF THE INVENTION

Prior to the conception and development of the present invention, storage containers, as are generally well known in the prior art, have been used to provide places to store articles. Additionally, novelty items, as are generally well known in the prior art, have been used for amusement.

Specifically of interest to the present invention are the following: Stobbart, U.S. Pat. No. 4,903,513, discloses a retaining apparatus for retaining emergency use articles. The retaining apparatus supports a break glass panel which conceals the emergency use article and the panel is mounted whereby it may be either fractured or released by removal of locking means to provide access to the article.

There is no prior art, however, regarding the combination of a novelty item and an emergency container. A new combination which could be both comedic and useful.

SUMMARY OF THE INVENTION

The present invention provides a combination article storage container and novelty item. Such combination article storage container and novelty item includes a housing, having a first predetermined size and first predetermined shape and being manufactured from a first predetermined material, a predetermined article, and a means for releasably attaching such predetermined article within such housing at a predetermined location therein. An outwardly facing transparent front panel manufactured from a second predetermined material is attached to such housing at a predetermined location thereon. A means is also included to provide access to such predetermined article for at least one of removing and replacing such predetermined article. A tool member is operably connected to such housing at a predetermined location on an outside of such housing for giving the appearance that in order to obtain such predetermined article such tool member must be used to break such transparent front panel.

OBJECTS OF THE INVENTION

It is, therefore, one of the primary objects of the present invention to provide a combination article storage container and novelty item to provide humor and amusement.

Another object of the present invention is to provide a combination article storage container and novelty item which will actually be useful should the need to utilize the predetermined article within the container arise.

Still another object of the present invention is to provide a predetermined article enclosed in a container and visible through a transparent material that can be hung on a wall or displayed on a shelf, dresser, table or the like to serve decorative as well as humorous purposes.

Yet another object of the present invention is to provide a special storage container for a predetermined article such that a person seeking such article could retrieve it from such storage container if desired or replace.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
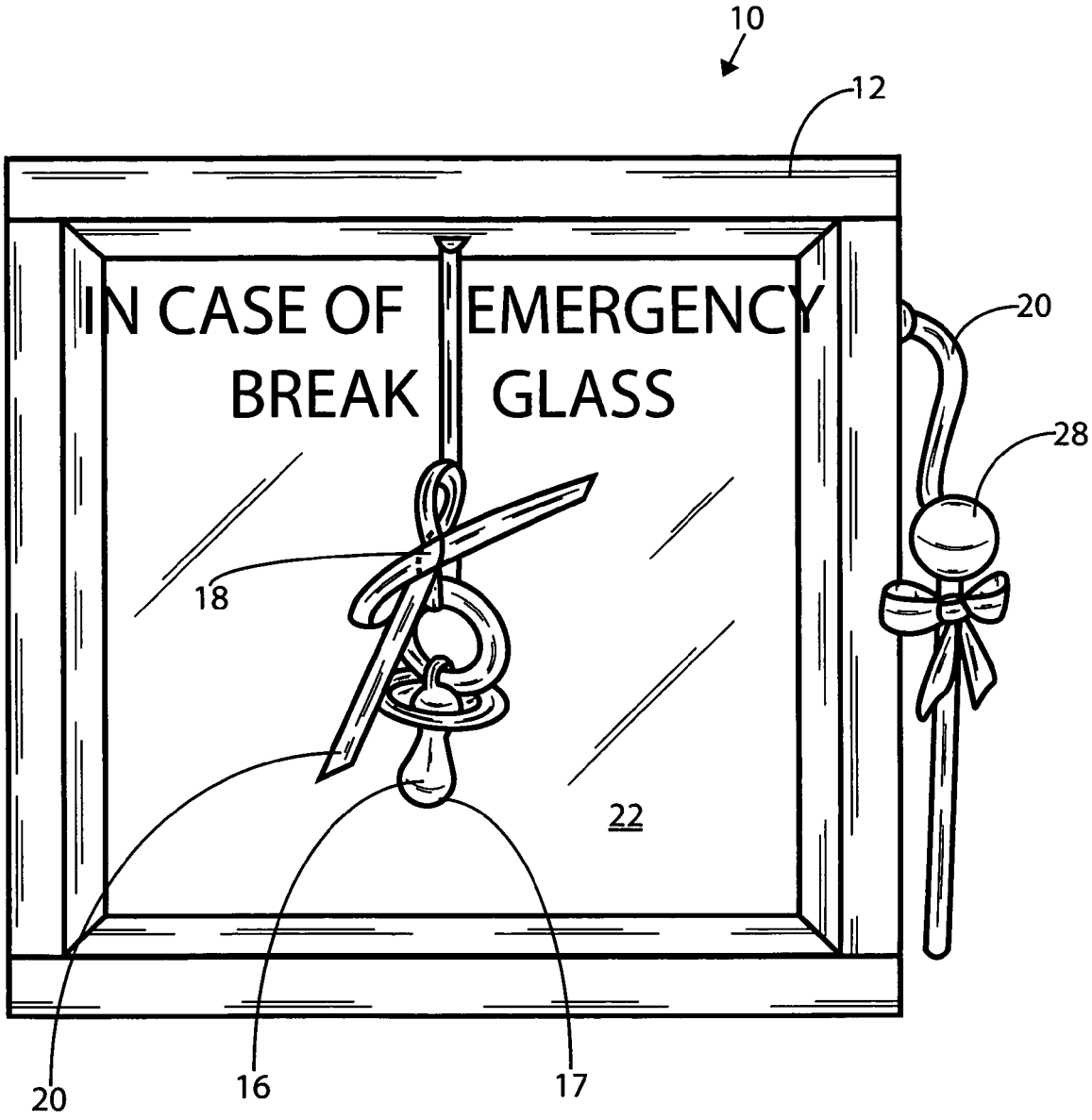
FIG. 1 is a partial perspective view of the invention according to a one embodiment of the invention.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Figure 2:
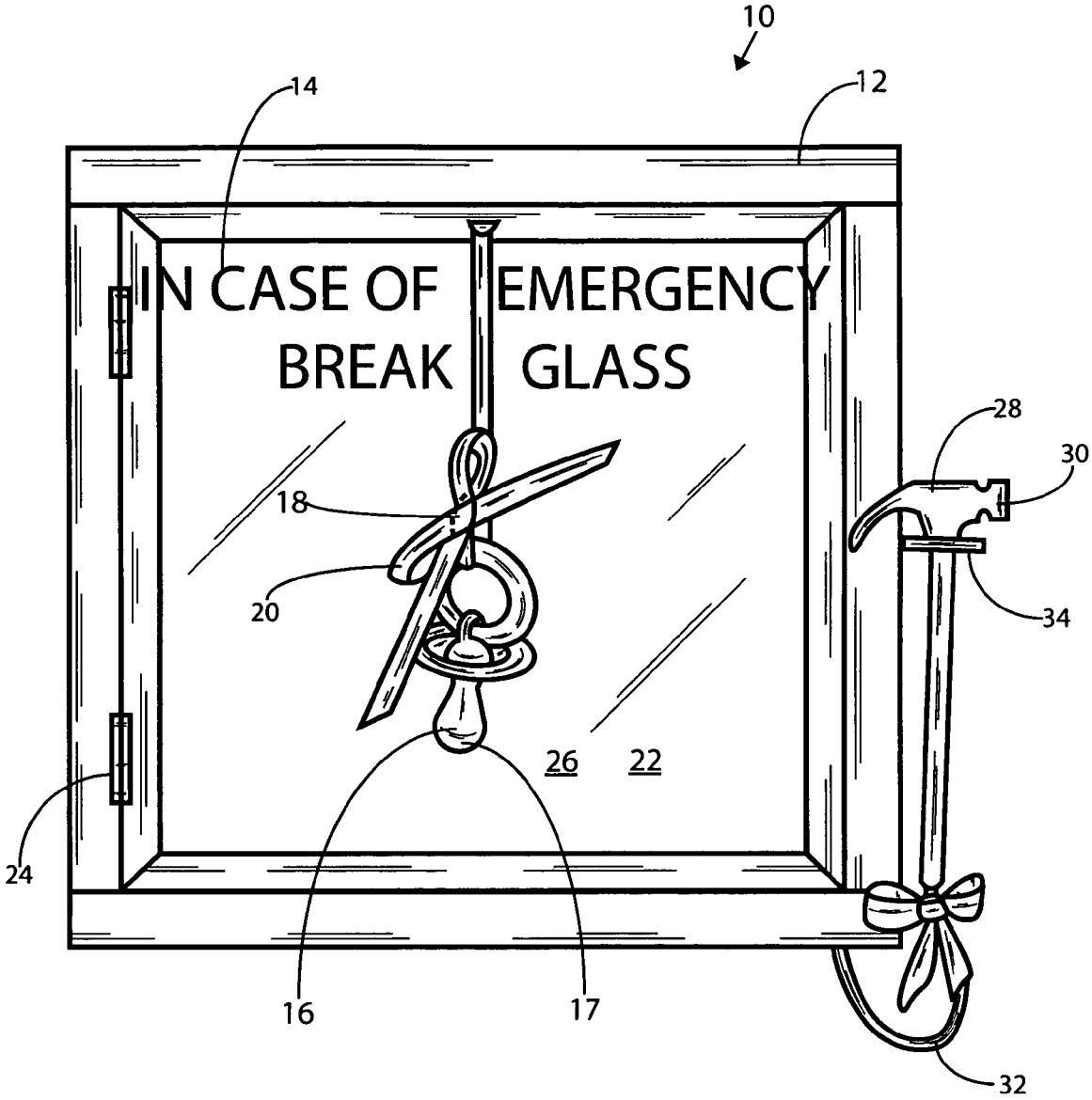
FIG. 2 is a partial perspective view of the invention according to one embodiment of the invention.

Reference is now made, more particularly, to FIGS. 1-2.

A combination article storage container and novelty item, generally designated 10, is provided. Such combination article storage container and novelty item 10 includes a housing 12 having a first predetermined size and first predetermined shape and being manufactured from a first predetermined material.

It is presently preferred that such first predetermined material is selected from the group consisting of wood, metal, and plastic. It is presently most preferred that such first predetermined material is plastic. It is further presently preferred that such first predetermined shape is generally rectangular. It is also presently preferred that the housing 12 is produced in a variety of colors. It is further presently preferred that the housing 12 further includes at least one of letters 14, words, symbols, and pictures. It is presently contemplated that such housing will include the phrase "In case of emergency break glass" or similar wording.

The invention includes a predetermined article 16 for storing within such housing. It is presently preferred that such predetermined article is at least one of a pacifier 17, a rattle, a chocolate bar, and a toy. It is presently most preferred that such predetermined article is a pacifier 17.

A means 18 is included for releasably attaching such predetermined article 16 within the housing 12 at a predetermined location therein. It is presently preferred that such means 18 for releasably attaching such predetermined article 16 to the housing 12 is at least one of a string, a ribbon 20, a wire, a hook, a hook and loop type fastening means, and a combination thereof operably connected to such housing at a predetermined location therein.

An outwardly facing transparent front panel 22 manufactured of a second predetermined material is attached to the housing 12 at a predetermined location thereon. It is presently preferred that such second predetermined material is at least one of glass and plastic. It is presently most preferred that such second predetermined material is plastic.

A means 24 for providing access to such predetermined article for at least one of removing and replacing such predetermined article 16 is provided. It is presently preferred that such means 24 to provide access to remove and replace such predetermined article 16 is a hinged door 26 operably connected to such housing 12 at a predetermined location thereon. It is most preferred that such transparent front panel 22 is such hinged door 26 providing access to such predetermined article for at least one of removing and replacing such predetermined article 16. It is also contemplated that such means to provide access to such predetermined article may be a sliding panel.

A tool member 28 is operably connected to the housing 12 at a predetermined location on an outside of the housing 12 for giving the appearance that in order to obtain such predetermined article 16 the tool member 28 must be used to break the transparent front panel 22. It is presently preferred that such tool member 28 is at least one of a mallet and a hammer. It is presently most preferred that such tool member is a hammer 30. It is further presently preferred that such tool member 28 is operably connected to the housing 12 by at least one of a string 32, a ribbon 20, a wire 34, a hook, and a combination thereof.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

I claim:

1. In combination with a pacifier having a nipple for sucking on by an infant such that such infant is soothed, the improvement comprising a combination article storage container and novelty item having;

a. a housing having a first predetermined size and first predetermined shape and being manufactured from a first predetermined material;

b. a means for releasably attaching said pacifier within said housing at a predetermined location therein;

c. an outwardly facing transparent front panel manufactured from a second predetermined material and attached to said housing at a predetermined location thereon;

d. a means for providing access to said pacifier for at least one of removing and replacing said pacifier; and e. a tool member operably connected to said housing at a predetermined location on an outside of said housing for giving the appearance that in order to obtain said pacifier said tool member must be used to break said transparent front panel.

2. The combination according to claim 1 wherein said first predetermined material is selected from the group consisting of wood, metal, and plastic.

3. The combination according to claim 2 wherein said first predetermined material is plastic.

4. The combination according to claim 1 wherein said means for attaching said pacifier to said housing is at least one of a string, a ribbon, a wire, a hook, a hook and loop type fastening means, and a combination thereof operably connected to said housing at a predetermined location therein.

5. The combination according to claim 1 wherein said tool member is at least one of a mallet and a hammer.

6. The combination according to claim 1 wherein said tool member is a hammer.

7. The combination according to claim 1 wherein said means to provide access to remove and replace said pacifier as necessary is a hinged door operably connected to said housing at a predetermined location thereon.

8. The combination according to claim 1 wherein said housing is produced in a variety of colors.

9. The combination according to claim 1 wherein said first predetermined shape is generally rectangular.

10. The combination according to claim 1 wherein said tool member is operably connected to said housing by at least one of a string, a ribbon, a wire, a hook, and a combination thereof.

11. The combination according to claim 1 wherein said housing further includes at least one of letters, words, symbols, and pictures.

12. The combination according to claim 1 wherein said second predetermined material is at least one of glass and plastic.

13. The combination according to claim 12 wherein said second predetermined material is plastic.

14. The combination according to claim 7 wherein said hinged door is said outwardly facing transparent front panel.

* * * * *